US006427514B1

(12) United States Patent
Thiede

(10) Patent No.: US 6,427,514 B1
(45) Date of Patent: Aug. 6, 2002

(54) INSTALLATION TOOL FOR DEFORMABLE HEAD FASTENERS

(76) Inventor: Donald F. Thiede, 150 Jenny La., Danville, VA (US) 24541

( * ) Notice: Subject to any disclaimer, the term of this patent is extended or adjusted under 35 U.S.C. 154(b) by 0 days.

(21) Appl. No.: 09/962,024

(22) Filed: Sep. 26, 2001

Related U.S. Application Data

(60) Provisional application No. 60/235,603, filed on Jul. 27, 2000.

(51) Int. Cl.[7] ..... B21D 9/05; B21J 15/34
(52) U.S. Cl. ..... 72/391.8; 72/114
(58) Field of Search ..... 72/391.8, 114

(56) References Cited

U.S. PATENT DOCUMENTS 3,008,598 A * 11/1961 Martin ..... 72/391.8
3,197,987 A * 8/1965 Martin ..... 72/114
3,263,466 A * 8/1966 Shackelford ..... 72/114
3,686,915 A * 8/1972 Miller et al. ..... 72/391.8
4,402,203 A * 9/1983 Molina ..... 72/114

* cited by examiner

*Primary Examiner*—David Jones
(74) *Attorney, Agent, or Firm*—Mills Law Firm PLLC

(57) ABSTRACT

A drill mounted tool for installing collapsible deformable head fasteners includes a yoke supported on the drill housing carrying a reciprocal nosepiece rotatably coupled at a left hand threaded connection to an actuator shaft connected to the drill chuck. The actuator shaft has an external projecting right hand threaded end for carrying the fastener. Upon drill actuation, the actuator shaft extends the nosepiece relative to the actuator shaft thereby collapsing and deforming the fastener into secure engagement with a workpiece.

10 Claims, 7 Drawing Sheets

INSTALLATION TOOL FOR DEFORMABLE HEAD FASTENERS

RELATED APPLICATION

The present invention claims the benefit of U.S. Provisional Application No. 60/235,603 filed on Jul. 27, 2000 in the name of Donald R. Thiede and entitled "Fastener Installation Tool".

FIELD OF THE INVENTION

The present invention relates to the installation of fasteners and, in particular, to a tool for installing collapsible fasteners.

BACKGROUND OF THE INVENTION

The present invention provides an installation tool for a class of fasteners consisting of axially compressible, radially expandable threaded fastener inserts that are attached to a workpiece and coupled with a threaded bolt to effect a mounting relationship with an associated component. The commercially available inserts, also know as rivet nuts and threaded inserts, are axially compressed by a suitable, thereby radially expanding and securing the fastener for permanent installation on a workpiece.

Inasmuch as substantial force is required to deform the fastener, specialized tools have been developed for facilitating installation. In one approach, as disclosed in U.S. Pat. No. 4,425,782 to Todisco, a hand held setting tool includes a mandrel having a threaded end for holding the fastener and an anvil for axially engaging the fastener against the workpiece. By compressing a pair of pivotal handles, the mandrel is upwardly telescoped relative to the mandrel, whereby the shank of the fastener is shortened causing radial expansion into secure engagement with the workpiece. Thereafter, the mandrel is manually unthreaded from the fastener to complete the installation. The tool requires that the operator use both hands to develop sufficient force to collapse the fastener, presenting safety concerns for installation in difficult to reach locations. Further, the multiple threading steps for mounting and releasing the fastener at the installation tool is cumbersome, time consuming and costly.

To overcome the foregoing limitations of the manual tools, a single purpose, air-powered setting tool, of the type disclosed in U.S. Pat. No. 4,045,994 to De Maio et al., has been proposed for threading the fastener onto the mandrel, collapsing the fastener, and unthreading the mandrel after installation. While somewhat automating the installation procedure and allowing single hand operation, such equipment is very costly, and not affordable to most operators. Further, the tool must be accurately preset to avoid stripping the insert threads during installation.

Accordingly, a need persists for an improved installation tool for collapsible fasteners that is affordable, easy to use, and provides high productivity.

BRIEF SUMMARY OF THE INVENTION

The present invention provides an installation tool for collapsible deformable head fasteners that are automatically operated by widely available and affordable reversible drills. The installation tool includes a yoke assembly supported on the drill housing carrying a reciprocal nosepiece. An actuator shaft is coupled at an inert end to the drill chuck. The other end is provided with a right hand thread for carrying the fastener. An intermediate section of the actuator shaft includes a left hand thread section coupled to the nosepiece.

Upon drill actuation, the actuator nosepiece extends relative to the yoke thereby collapsing the fastener into secure engagement with a mounting surface.

Accordingly, it is an object of the present invention to provide an installation tool for deformable insert rivet nuts that may be operated by a readily available power tool.

Another object of the invention is to provide an installation tool for collapsible fasteners that permits single-handed installation.

A further object of the present invention is to provide an installation tool connected to a conventional a reversible drill for safely and quickly installing deformable head fasteners to a workpiece.

DESCRIPTION OF THE DRAWINGS

The above and other objects of the invention will become apparent upon reading the following detailed description taken in conjunction with the accompanying drawings in which.

DETAILED DESCRIPTION OF THE PREFERRED EMBODIMENT

Figure 1:
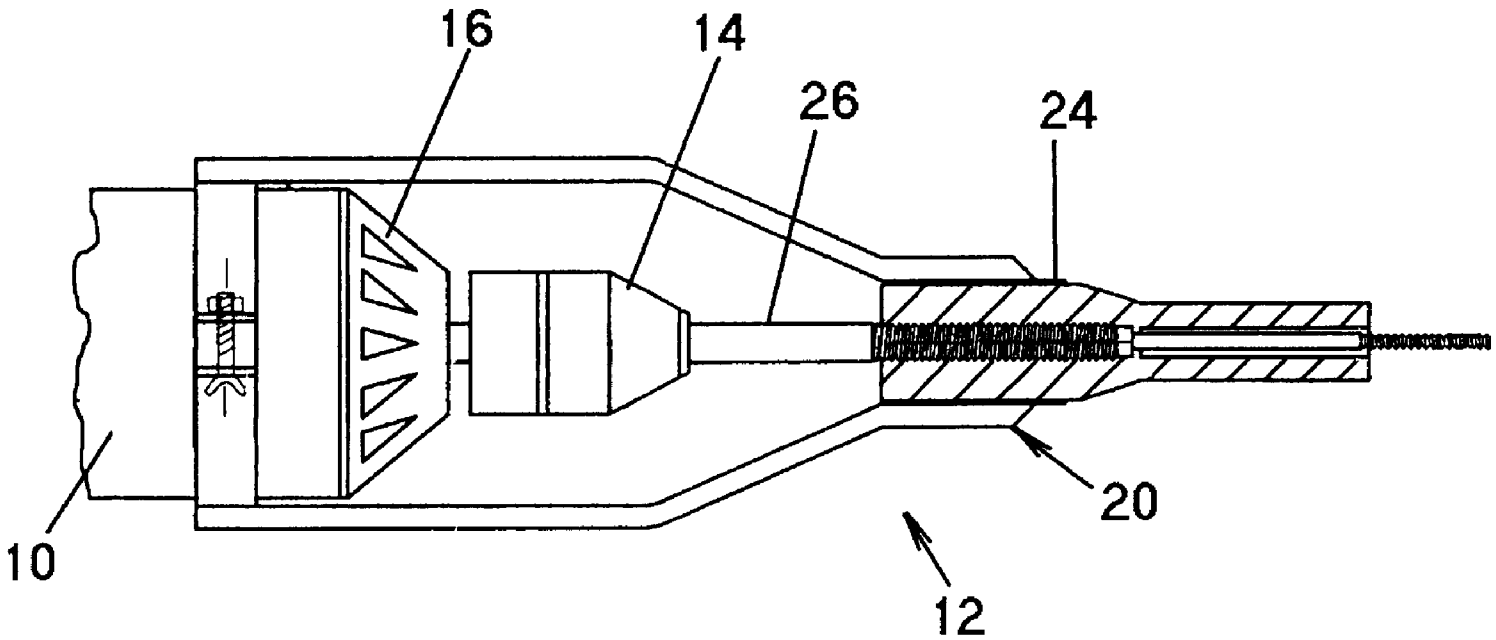
FIG. 1 is a partially sectioned top view of a fastener installation tool mounted on a variable speed drill in accordance with a preferred embodiment of the invention.
Figure 2:
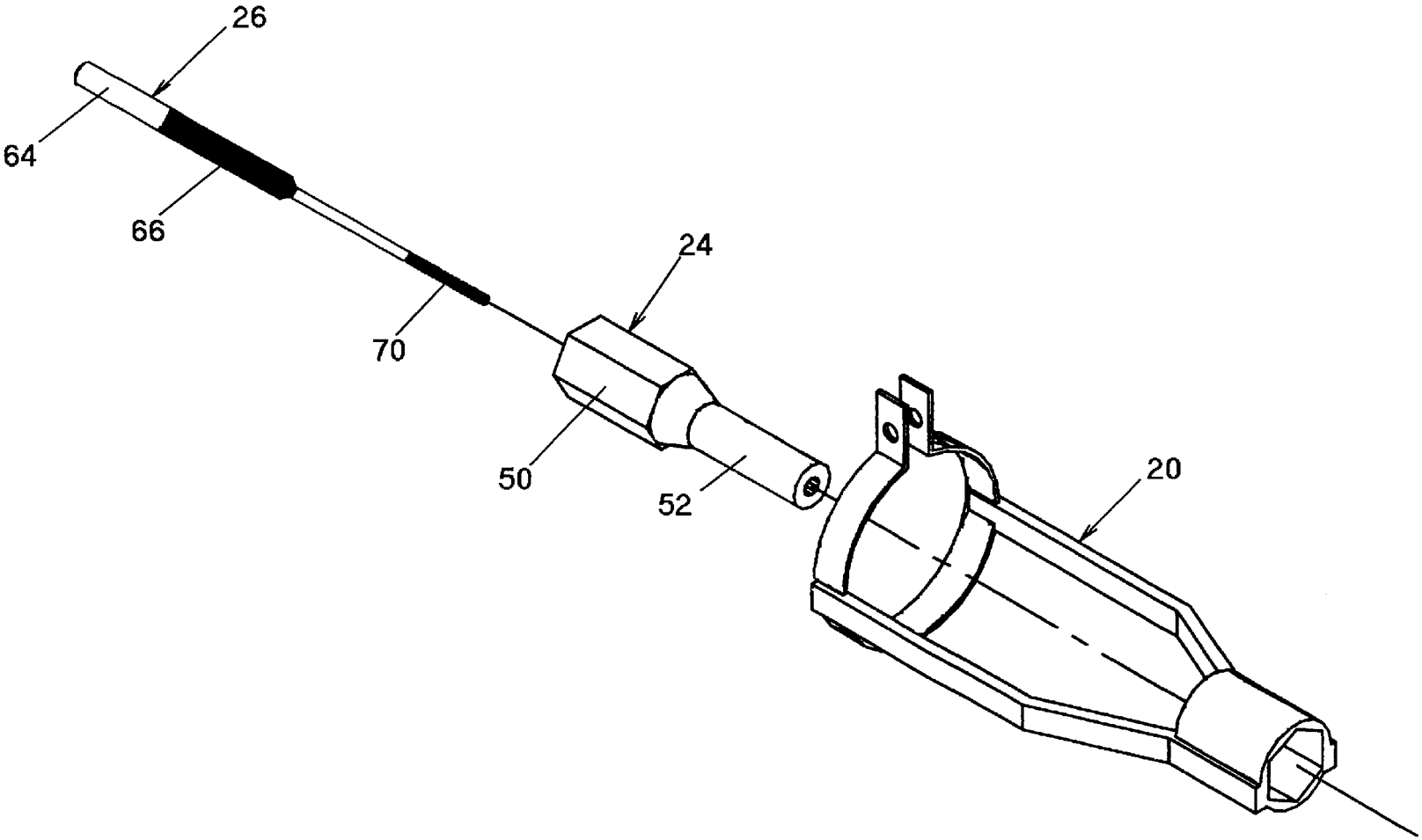
FIG. 2 is an exploded view of the installation tool shown in FIG. 1.

Referring to the drawings for the purpose of illustrating the preferred embodiment and not for limiting same, FIG. 1 illustrates a reversible portable electric drill 10 having a collapsible fastener installation tool 12 operatively coupled thereto. The drill 10 is a commercially available portable electric rechargeable model having a reversible motor for selectively reversing the rotation of a chuck 14. The drill 10 is provided with a variable clutch 16 for limiting the torque applied at the chuck 14. A suitable drill is available from DeWalt as model DW992 with a XR2 18 volt battery pack.

The installation tool 12 comprises a torque yoke 20 removably carried on the housing 22 of the drill 10, a reciprocating actuator nosepiece 24, and a dual threaded actuator shaft 26. As described in greater detail below, the actuator nosepiece 24 is axially telescoped inwardly and outwardly through appropriate motor actuation of the drill 10 for installation of collapsible fasteners.

Figure 10:
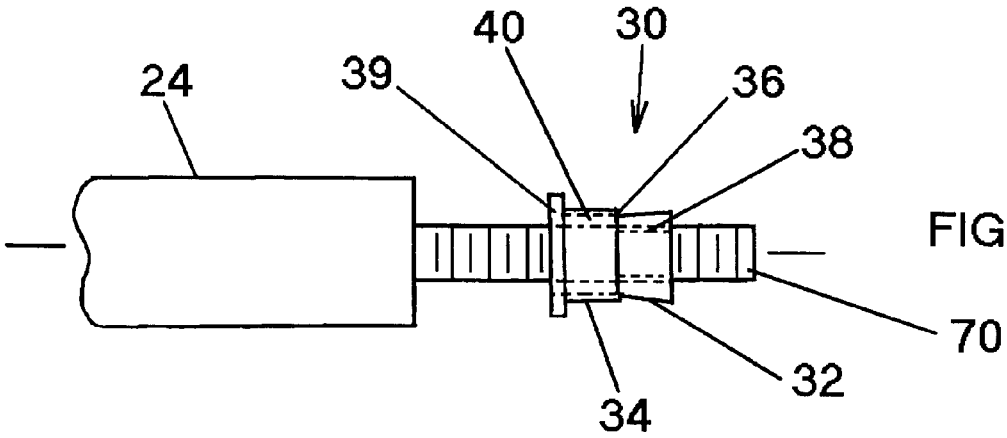
FIG. 10 is side elevational view of the fastener on the actuator shaft in the mounting condition.

Referring to FIG. 10, a typical fastener 30 comprises a unitary cylindrical body including a threaded shank 32 and a skirt 34 integrally connected at an annular frangible section 36. The shank 32 has a threaded bore 38 with a conventional right hand thread. The skirt 34 is provided with an annular flange 39 and an outwardly opening bore 40 having a diameter complementary to the outer surface 41 of the shank 32. In installation, the fastener 30 is received in a clearance opening in a workpiece 42. A suitable fastener is available as Thread-Sert fastener from Marson Creative Fastener, Inc. as Product No. 0128227.

Figure 12:
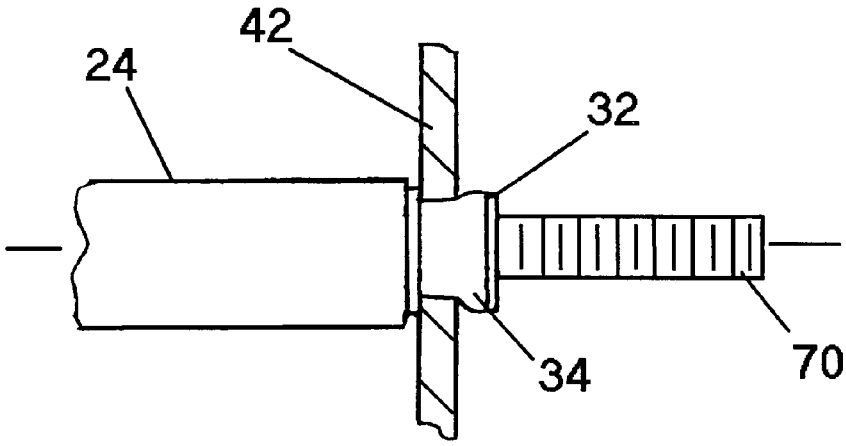
FIG. 12 is a partially sectioned side view of the fastener in the installed condition on the workpiece.

By operation of the installation tool 12, the fastener 30 is axially collapsed as shown in FIGS. 1 and 12 wherein the frangible section 36 is fractured and the shank 32 telescopes within the skirt 34 thereby shortening the fastener length and radially outwardly deforming the skirt 34 to effect axial and radial compressive engagement with the mounting panel 42.

Referring additionally to FIGS. 5 through 8, the actuator nosepiece 24 comprises a head section 50 of hexagonal cross section and a shank section 52 of circular cross section. The head section 50 is provided with a threaded counterbore 54 of left hand thread. The shank section 52 is provided with a through bore 56 provided by the tap drill for the threaded counterbore 54 at a diameter sufficient to establish a clearance relation with the outer end of the actuator shaft 26.

Figure 9:
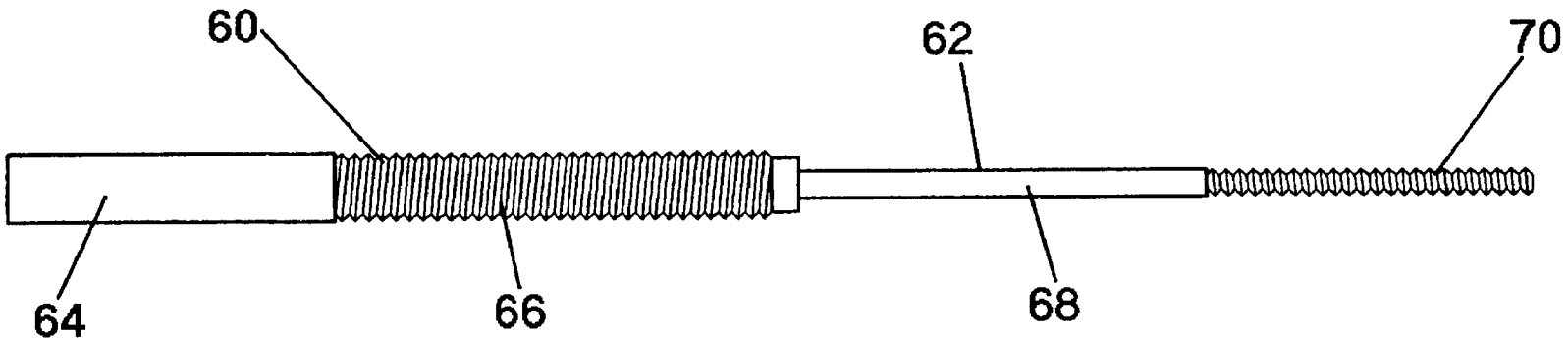
FIG. 9 is a side view of the actuator shaft of the fastener installation tool shown in FIG. 1.

As shown in FIG. 9, the actuator shaft 26 comprises an actuator section 60 and a fastener section 62. The actuator section 60 includes an outer cylindrical shank for receipt in the chuck 14 of the drill 10 and an actuator thread 66 of left hand thread for threaded engagement with the threaded counterbore 54 of the nosepiece 24. The fastener section 62 includes a center section 68 having a clearance relation with the threaded counterbore 54 and terminating with a threaded end 70 of right hand thread for threaded engagement with tile fastener 30. Accordingly, upon relative rotation of the nosepiece 24 and the shaft 26, the threaded end 70 is shifted between an extended position shown in FIG. 10 and a retracted position shown in FIG. 12.

Figure 3:
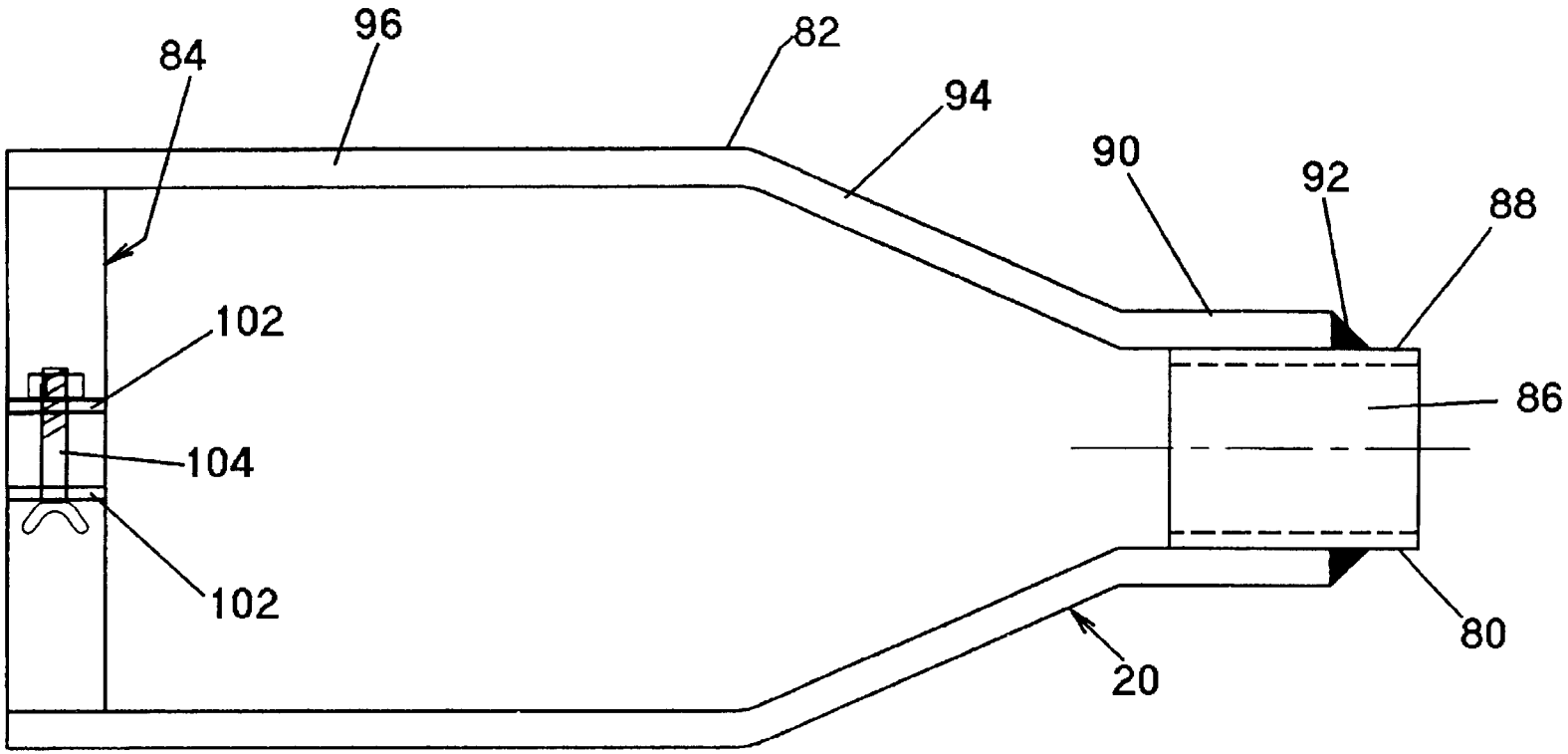
FIG. 3 is a top view of the yoke of the installation tool shown in FIG. 1.
Figure 4:
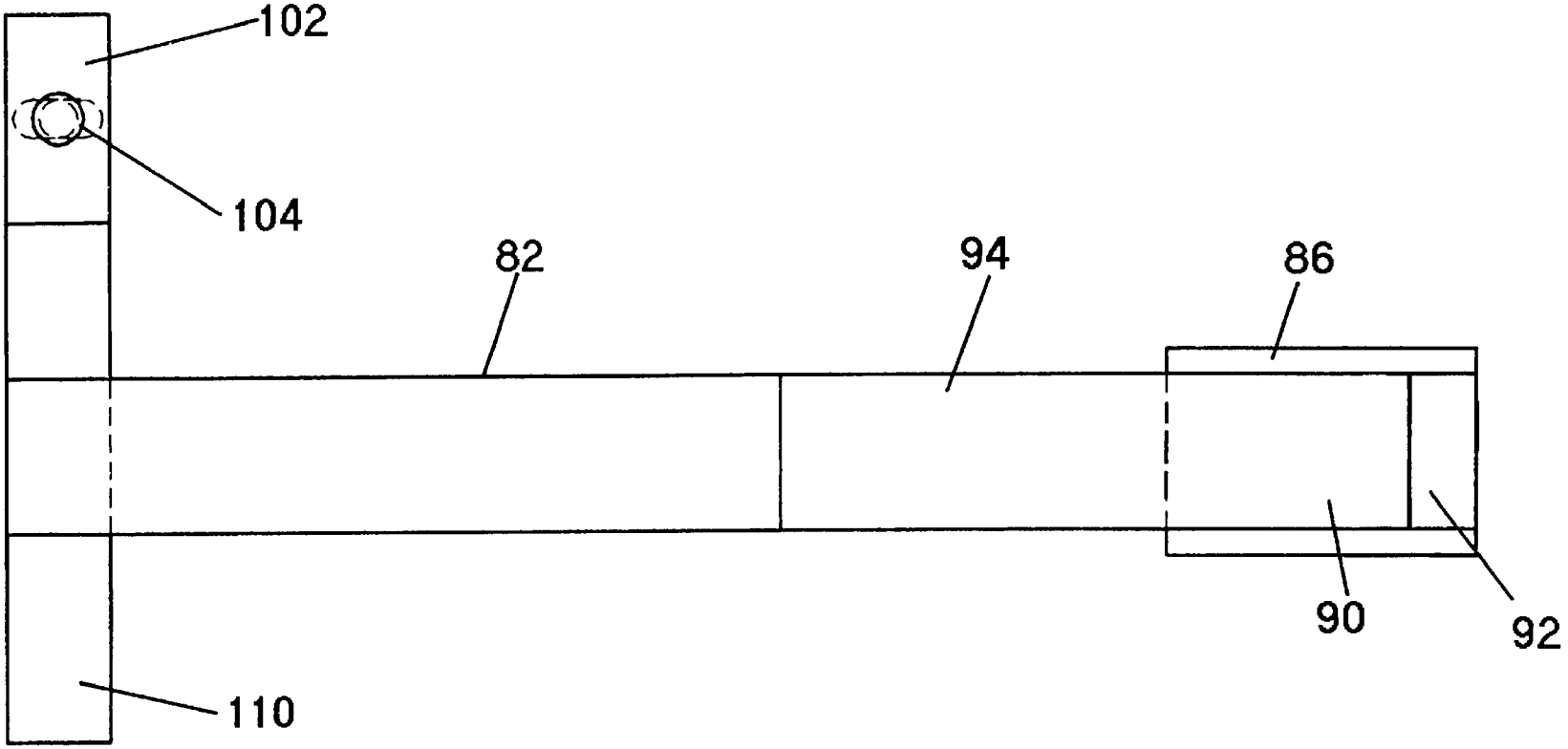
FIG. 4 is an end view of the yoke of the installation tool shown in FIG. 3.
Figure 7:
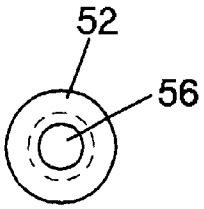
FIG. 7 is a right end view of the nosepiece shown in FIG. 5.
Figure 5:
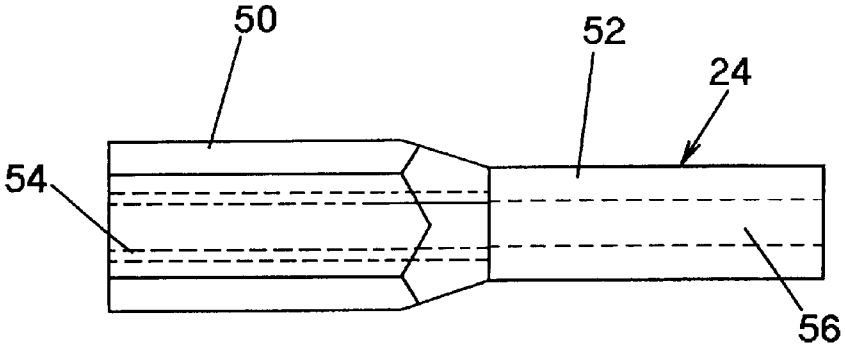
FIG. 5 is a side view of the nosepiece of the installation tool shown in FIG. 1.
Figure 8:
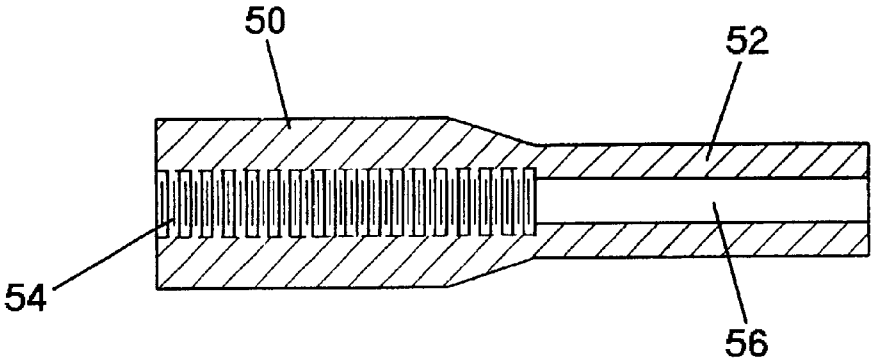
FIG. 8 is a cross sectional view of the nose piece shown in FIG. 5.
Figure 6:
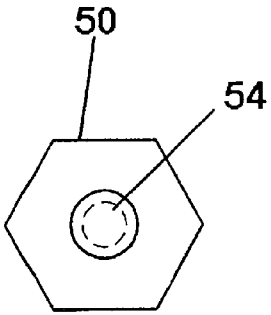

Referring to FIGS. 3 and 4, the yoke 20 comprises a support sleeve 80, a pair of mounting arms 82, and a mounting clamp 84. The support sleeve 80 includes a through bore 86 of a hexagonal cross section for axially telescopically supporting the head section 50 of the nosepiece 24, and a cylindrical outer surface 88. Each of the arms 82 has a generally rectangular cross section and includes a front section 90 fixedly connected to the sleeve 80 at welds 92, an outwardly flared center section 94, and a rearwardly extending rear section 96 connected to the outer surface of the mounting clamp 84. The mounting clamp 84 includes a split cylindrical adjustable band 100 telescopically receivable over the frontal nose of the drill housing 22, and a pair of circumferentially spaced, radially outwardly turned legs 102 adjustably interconnected by bolt and nut fastener assembly 104. As will be apparent, the band 100 may be adjustably fixedly clamped to the nose section by adjustment of the fastener assembly 104.

Figure 11:
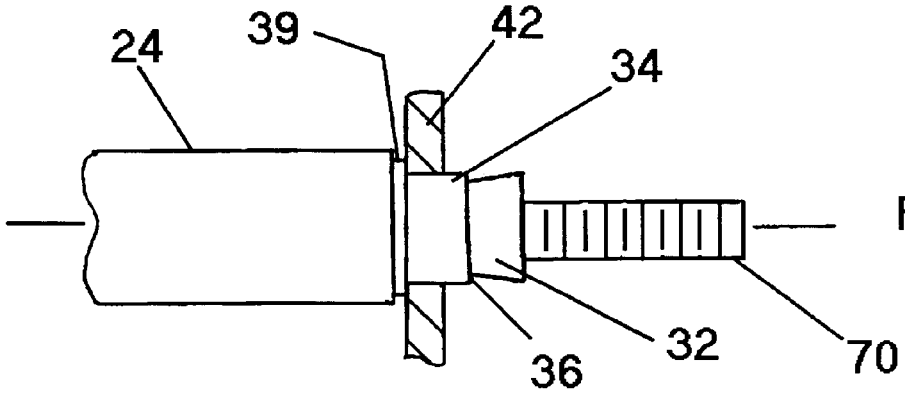
FIG. 11 is a partially section side view of the fastener at the workpiece prior to installation.

In operation, the yoke 20 is mounted on the drill 10 and the inner end 64 of the shaft 26 clamped in the jaws of the drill chuck 14. The drill 10 is actuated to outwardly extend the installation end sufficiently to receive the fastener as shown in FIG. 10. Holding the fastener, the drill is actuated to thread the fastener onto the outer threaded end 70. The fastener 30 may then be inserted into a hole of a mounting component. With the fastener securely engaging the workpiece, the drill 10 is reversely actuated, and the actuator thread 66 rotates relative to the yoke sleeve 88 thereby retracting the bit 26 relative to the nosepiece 24 until the end of the nosepiece engages the flange 39 as shown in FIG. 11. Further rotation and initiates fracture of the frangible section 39. Further compression results in the installation condition shown in FIG. 12 wherein the skirt of the fastener is radially outwardly expanded for effective mechanical compressive engagement with the mounting component. Upon achieving the installation condition, the torque on the bit 26 substantially increases effective for releasing the clutch on the drill 10. The torque increase is also sufficient to provide operator indication for assembly with non-clutch drills. Upon satisfactory completion, the drill is reversed to unthread the actuator shaft from the fastener.

For accommodating varying sizes of fasteners, a plurality of sleeve and bit subassemblies may be provided. For accommodating varying drills, the clamp assembly may be suitably adapted.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed is:

1. An installation tool for use with a reversible drill for mounting a collapsible fastener, the fastener having a rear end with an internal right hand thread and an a cylindrical front end, comprising: an actuator shaft having an inner end for connection with the drill and an outer end having an external right hand thread for threaded coupling with the internal right hand thread of the fastener, said actuator shaft having an intermediate section of external left hand thread; a coupling member threadedly connected with said intermediate section of said actuator shaft; and mounting means slidably supporting said coupling member and including releasable means for mounting on said drill.

2. The installation tool as set forth in claim 1 wherein said coupling member is slidably connected to said mounting means at a non-rotatable connection.

3. The installation tool as set forth in claim 2 wherein said non-rotatable connection is polygonal.

4. The installation tool as set forth in claim 3 wherein said coupling member said coupling member has a hexagonal cross section, and said mounting means includes a hexagonal socket slidably and non-rotatably carrying said coupling member.

5. The installation tool as recited in claim 4 wherein said mounting member includes a cylindrical sleeve carrying said coupling member and a pair of opposed arms connected at outer ends to said sleeve and connected at inner ends to a contractible member for connection to the drill.

6. The installation tool as recited in claim 5 wherein coupling member has an annular face engagable with the front end of the fastener.

7. In combination, an electric drill having a rotatable chuck, an actuator shaft having an inner end connected to said chuck and an outer end having an external right hand thread for threaded coupling with a deformable fastener, an intermediate section on said shaft of external left hand thread; a nose coupling member threadedly connected to said intermediate section; and means for slidably supporting said coupling member and being releasaby mounted on said drill.

8. The combination as recited in claim 7 wherein said drill is reversible.

9. The combination as recited in claim 8 wherein said chuck includes a variable clutch member.

10. A method for installing a deformable head fastener having an outer end with an internal right hand thread a cylindrical inner end having an external annular flange; comprising the steps of: providing a reversible electric drill having a chuck; coupling an actuator shaft at an inner end to said drill at said chuck; providing an external right hand thread at an outer end of said actuator for threaded connection with said outer end of said fastener; providing an intermediate section of said actuator shaft with an external left hand thread; providing a coupling member with an internal left hand thread; connecting said coupling member to said intermediate section at said threads; providing a mounting bracket on said drill; and slidably and non-rotatably supporting said coupling member on said mounting bracket.

* * * * *